US006536351B2

(12) United States Patent
Böcker et al.

(10) Patent No.: US 6,536,351 B2
(45) Date of Patent: Mar. 25, 2003

(54) WARHEAD

(75) Inventors: Jürgen Böcker, Oberhausen (DE); Paul Wanninger, Hermannsburg (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 09/989,755

(22) Filed: Nov. 21, 2001

(65) Prior Publication Data

US 2002/0121215 A1 Sep. 5, 2002

(30) Foreign Application Priority Data

Nov. 21, 2000 (DE) ..... 100 57 673

(51) Int. Cl.[7] ..... F42B 12/04; F42B 12/08; F42B 12/22

(52) U.S. Cl. ..... 102/478; 102/493; 102/492; 102/494; 102/497

(58) Field of Search ..... 102/307, 308, 102/310, 478, 475, 473, 498, 491, 493–497, 476

(56) References Cited

U.S. PATENT DOCUMENTS 1,236,736 A * 8/1917 Miller ..... 102/478
3,980,021 A * 9/1976 Strandli
3,992,996 A * 11/1976 Strandli
4,003,313 A * 1/1977 Puchalski
4,284,007 A * 8/1981 Arnell et al.
4,353,302 A * 10/1982 Strandli et al.
4,612,859 A * 9/1986 Furch et al.
4,625,650 A * 12/1986 Bilsbury ..... 102/473
4,648,324 A * 3/1987 McDermott
5,020,439 A * 6/1991 Winter et al. ..... 102/473
5,054,396 A * 10/1991 Grommes et al.
5,121,691 A * 6/1992 Nicolas
5,164,533 A * 11/1992 Schluckebier
5,191,169 A * 3/1993 Hu
5,303,654 A * 4/1994 Held
5,515,786 A * 5/1996 Schilling et al.
5,542,354 A * 8/1996 Sigler ..... 102/478
5,996,501 A * 12/1999 Spencer et al. ..... 102/473
6,041,713 A * 3/2000 Altenau et al. ..... 102/498
6,135,028 A * 10/2000 Kuhns et al. ..... 102/473

FOREIGN PATENT DOCUMENTS

DE 38 34 491 A1 4/1990

* cited by examiner

*Primary Examiner*—Michael J. Carone
*Assistant Examiner*—Lulit Semunegus
(74) *Attorney, Agent, or Firm*—Venable; Norman N. Kunitz

(57) ABSTRACT

A warhead (1) having a warhead casing (2) that encloses an explosive charge (5). To ensure that, during the detonation of the explosive charge (5), the warhead (1) effects a rapid acceleration of the fragments flying in the flight direction, and a lesser acceleration of the fragments flying away laterally from the warhead, and/or generates a relatively intense lateral pressure wave, the charge has at least two different partial charges (7, 8–10) corresponding to the intended use of the warhead (1). The first partial charge (7), which is disposed in the region of the tip of the warhead (1), and comprises, for example, octogen (HMX), possesses a high detonation speed in order, when detonated, to accelerate heavy-metal fragments (preferably WSM spherical fragments) disposed in front of the partial charge very rapidly forward. In contrast, the second partial charge (8–10), which adjoins the rear of the first partial charge (7), is a far less costly charge, e.g., RDX, is required solely for accelerating the fragments, comprising steel, for example, that are flying away laterally, or only to generate an intense lateral pressure wave.

9 Claims, 1 Drawing Sheet

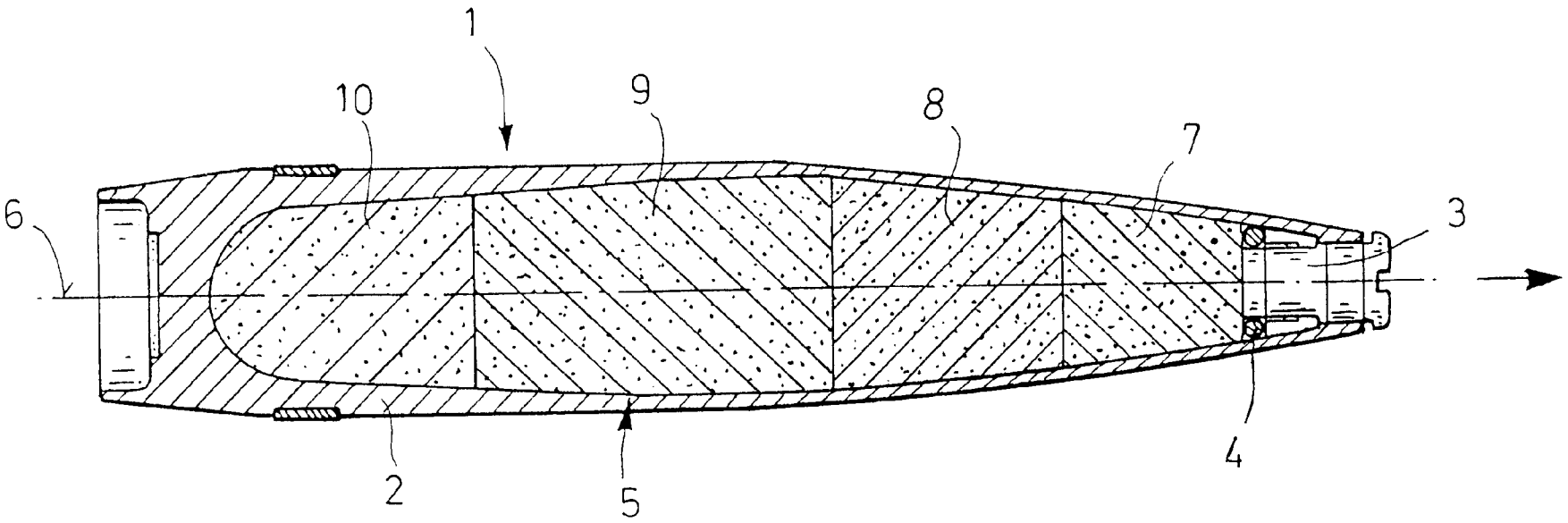
1
2
3
4
5
6
7
8
9
10

WARHEAD

CROSS REFERENCE TO RELATED APPLICATION

This application claims the priority of German Patent Application No. 100 57 673.7 filed Nov. 21, 2000 which is incorporated herein by reference.

BACKGROUND OF THE INVENTION

The invention relates to a warhead having a warhead casing that encloses an explosive charge. It is a long-standing practice to use plastic-bound explosive charges in large-caliber projectiles. The charges of the known warheads typically comprise a single material that is selected so that the fragments created in the charge detonation exhibit a predetermined acceleration and angular distribution in a specific direction, e.g., in the flight direction. Correspondingly, fragments that fly in a different direction, e.g., perpendicular to the flight direction, are likewise greatly accelerated, although such a significant acceleration of these fragments is entirely unnecessary.

German Published Patent Application DE 38 34 491 A1 discloses an explosive charge that forms a projectile and possesses a lining. The charge includes an initial charge as well as a plurality of different partial charges that are disposed one behind the other, seen in the direction of the longitudinal axis of the warhead, and whose detonation speeds increase in the direction of the lining, starting from the initial charge. With this type of arrangement of different partial charges, the jet or projectile speed possesses a greater penetrating power than comparable warheads whose charge has a constant detonation speed. This patent application does not focus on the structure of warheads for accelerating fragments (fragmentary projectiles) in different directions.

It is the object of the invention to provide a warhead of the type mentioned at the outset, which effects a considerable acceleration of the fragments flying in the flight direction, on the one hand, and effects a lesser acceleration of the fragments flying away from the warhead, on the other hand, and/or in which a relatively intense lateral pressure wave is created.

SUMMARY OF THE INVENTION

The above object generally is accomplished according to the invention by a warhead comprising a warhead casing, a fuze disposed at a front end of the casing, a heavy metal fragment plate disposed in the facing adjacent to said fuze, and an explosive charge disposed within the casing; and wherein the explosive charge comprises: at least first and second partial charges, each formed of an explosive and a plastic binder, that adjoin one another, when seen in the direction of a longitudinal axis of the warhead, with the first partial charge, which faces the front end of the warhead, being comprised of an explosive that has a higher detonation speed than the second partial charge, and being such that the heavy-metal fragments disposed at the front of the warhead are accelerated axially when the explosive is detonated, and with the second partial charge being selected such that it serves as one of a fragment-accelerating charge for producing fragments that fly away laterally from the warhead, and a charge for generating a pressure wave that is effective to the side of the warhead. Further, particularly advantageous, embodiments of the invention are disclosed and described.

The invention is essentially based on the concept of not arranging a single type of charge in the warhead casing, but providing at least two different charges. The first partial charge, which is disposed in the tip region of the warhead, comprises, for example, octogen (homocyclonite, (HMX), and has a high detonation speed in order to accelerate the heavy-metal fragments (preferably tungsten heavy metal (WSM) spherical fragments) disposed in front of it very rapidly forward (in the flight direction) when the explosive charge is detonated. In contrast, the second partial charge, which adjoins the rear of the first partial charge, is a far less expensive charge, e.g., a hexagen (cyclonite, RDX) charge. This partial charge is solely required for accelerating the fragments, preferably made of steel, that fly off laterally. Instead of a fragment-accelerating charge, an explosive that merely generates an intense lateral pressure wave can be used as the second charge.

It has proven advantageous for the first partial charge to comprise a mixture of 70–90 percent by volume of octogen (HMX) and 10–30 percent by volume of an inert plastic binder (e.g., hydroxyl-terminated polybutadiene (HTPB)), and for the second partial charge to comprise a mixture of 70–90 percent by volume of hexogen (cyclonite, RDX) and likewise 10–30 percent by volume of a plastic binder. The same binder should be used in both partial charges.

A metal powder, such as aluminum powder is preferably added to the second partial charge to produce a blast effect.

Further details and advantages of the invention ensue from the exemplary embodiment explained in conjunction with a figure.

BRIEF DESCRIPTION OF THE DRAWINGS

The Figure is a sectional view of a warhead according to a preferred embodiment of the invention.

DESCRIPTION OF THE PREFERRED EMBODIMENTS

The Figure shows a ballistic warhead 1 that can be fired from a gun. The warhead 1 is intended to be used against bunkered targets, as well as to destroy vehicles that may be located to the side of the respective target. The warhead 1 comprises a steel warhead casing 2, a proximity fuze 3, which is located on the front of the warhead casing 2, a fragment plate 4 that adjoins the fuse and has heavy-metal fragments (e.g., WSM spheres, and an explosive charge 5 disposed with the casing 2. The explosive charge 5 comprises four partial charges 7 through 10, which are disposed one behind the other, seen in the direction of the longitudinal axis 6 of the warhead 1.

The first partial charge 7, which is adjacent to the fragment plate 4, comprises a mixture of, for example, 90% HMX and 10% of an HTPB binder system, and has a relatively high Guerney constant of 2830 m/s. This serves to accelerate the WSM spheres in the plate 4 particularly rapidly in the flight direction.

The partial charges 8 through 10 serve to produce fragments during the destruction of the warhead casing 2, and accelerate them as they fly away laterally from the warhead. RDX charges, which are far less costly than HMX charges, suffice for this purpose. The fragments can be construction fragments that are natural, or pre-formed in the casing.

To attain the best possible adaptation to the desired lateral fragment distribution of the warhead 1, the RDX partial charges 8 through 10 can have a different composition from region to region (e.g., charge 8: 85% RDX and 15% HTPB binder system; charge 9: 90% RDX and 10% HTPB binder system and charge 10: 70% RDX, 10% HTPB binder system and 20% aluminum powder).

To prepare the warhead 1, the warhead casing 2 is filled to a certain degree with the first partial charge 7. During the pot life of this mixture, the second mixture is poured onto the first partial charge, etc. The layered application of different formulas onto the base of the same polymer system results in a "tailored" effect (detonation speed) of the charge.

The invention now being fully described, it will be apparent to one of ordinary skill in the art that many changes and modifications can be made thereto without departing from the spirit or scope of the invention as set forth herein.

What is claimed is:

1. A warhead comprising:

a warhead casing, a fuze disposed at a front end of the casing, a heavy metal fragment plate disposed in the casing adjacent to said fuze, and an explosive charge disposed within the casing; and wherein the explosive charge comprises:

at least first and second partial charges, formed of an explosive and plastic binder that adjoin one another, when seen in the direction of a longitudinal axis of the warhead, with the first partial charge, which faces the front end of the warhead, being comprised of an explosive that has a higher detonation speed than the second partial charge, and being such that heavy metal fragments disposed at the front of the warhead are accelerated axially when the explosive is detonated, and with the second partial charge being selected such that it serves as one of a fragment-accelerating charge for producing fragments that fly away laterally from the warhead, and a charge for generating a pressure wave that is effective to the side of the warhead.

2. The warhead according to claim 1, wherein the first partial charge comprises 70–90 percent by volume of octogen (HMX) and 10–30 percent by volume of an inert plastic binder.

3. The warhead according to claim 2, wherein the first partial charge comprises 90% octogen and 10% of the binder.

4. The warhead according to claim 2, wherein the second partial charge comprises 70–90 percent by volume of hexogen (RDX) and 10–30 percent by volume of an inert plastic binder.

5. The warhead according to claim 1, wherein the explosive charge comprises four partial charges, with the first partial charge, which is adjacent to the tip of the warhead, comprising octogen and the adjoining partial charges comprising hexogen.

6. The warhead according to claim 1, wherein both charges have the same plastic binder.

7. The warhead according to claim 6, wherein the plastic binder is hydroxyl-terminated polybutadiene (HTPB).

8. The warhead according to claim 1, wherein a metal powder is added to the second partial charge.

9. The warhead according to claim 8, wherein the added metal powder is an aluminum powder.

* * * * *